US008358192B2

(12) United States Patent
Kireev et al.

(10) Patent No.: US 8,358,192 B2
(45) Date of Patent: Jan. 22, 2013

(54) MULTIPLE-LOOP SYMMETRICAL INDUCTOR

(75) Inventors: Vassili Kireev, Sunnyvale, CA (US); Parag Upadhyaya, San Jose, CA (US); Mark J. Marlett, Livermore, CA (US)

(73) Assignee: Xilinx, Inc., San Jose, CA (US)

( * ) Notice: Subject to any disclaimer, the term of this patent is extended or adjusted under 35 U.S.C. 154(b) by 0 days.

(21) Appl. No.: 13/463,497

(22) Filed: May 3, 2012

(65) Prior Publication Data

US 2012/0212315 A1 Aug. 23, 2012

Related U.S. Application Data

(62) Division of application No. 12/906,006, filed on Oct. 15, 2010, now abandoned.

(51) Int. Cl.

| | |
|---|---|
| ***H01F 27/29*** | (2006.01) |
| ***H01F 5/00*** | (2006.01) |
| ***H01F 27/28*** | (2006.01) |
| ***H01F 7/06*** | (2006.01) |

(52) U.S. Cl. ..... 336/192; 336/222; 336/200; 29/602.1

(58) Field of Classification Search ..... 336/192, 336/200, 223, 150, 222; 29/602.1

See application file for complete search history.

(56) References Cited

U.S. PATENT DOCUMENTS

| | | | | |
|---|---|---|---|---|
| 6,759,937 | B2 | 7/2004 | Kyriazidou | |
| 7,091,814 | B2 | 8/2006 | Kyriazidou | |
| 7,489,220 | B2 | 2/2009 | Baumgartner et al. | |
| 7,692,511 | B2 | 4/2010 | Degani et al. | |
| 7,825,764 | B2 | 11/2010 | Feldtkeller | |
| 2003/0222750 | A1 | 12/2003 | Kyriazidou | |
| 2004/0075521 | A1 | 4/2004 | Yu et al. | |
| 2004/0108933 | A1 * | 6/2004 | Chen et al. | 336/200 |
| 2004/0108935 | A1 * | 6/2004 | Kyriazidou | 336/200 |
| 2006/0284718 | A1 * | 12/2006 | Baumgartner et al. | 336/223 |
| 2008/0079527 | A1 | 4/2008 | Lee | |
| 2009/0027152 | A1 | 1/2009 | Gianesello | |

(Continued)

FOREIGN PATENT DOCUMENTS

DE 102 61 385 A1 7/2004

OTHER PUBLICATIONS

Lee, Jri et al., A 20-Gb/s 2-t-1 MUX and a 40-GHz VCO in 0.18-μm CMOS Technology, 2005 Symposium on VLSI Circuits Digest of Technical Papers, 9-2, Jun. 16-18, 2005, pp. 136-139.

(Continued)

*Primary Examiner* — Mohamad Musleh
*Assistant Examiner* — Mangtin Lian
(74) *Attorney, Agent, or Firm* — LeRoy D. Maunu

(57) ABSTRACT

A symmetrical inductor includes an integrated circuit having a plurality of conductive layers. A first loop is disposed in an upper layer of the conductive layers, and at least two strapped loops are disposed in at least two layers of the conductive layers, respectively. The strapped loops are coupled in series to the first loop, and the at least two layers are below the upper layer. A second loop is disposed in the upper layer and is coupled in series to the at least two strapped loops. A first terminal electrode is coupled to the first loop, and a second terminal electrode is coupled to the second loop. A center-tap electrode is coupled to the at least two strapped loops.

16 Claims, 6 Drawing Sheets

U.S. PATENT DOCUMENTS

2012/0092119 A1 4/2012 Kireev et al.

OTHER PUBLICATIONS

Lin, Liang, et al., Implementation of New CMOS Differential Stacked Spiral Inductor for VCO Design, IEEE Mircowave and Wireless Components Letters, vol. 17, No. 10, Oct. 2007, pp. 727-729.

Pillai, E., et al., Novel T-Coil Structure and Implementation in a 6.4-Gb/s CMOS Receiver to Meet Return Loss Specifications, 2007 Electronic Components and Technology Conference, ETOC'07, May 29-Jun. 1, 2007, pp. 147-153.

Politi, M. et al., Multi-Layer Realization of Symmetrical Differential Inductors for RF Silicon IC's, 33rd European Microwave Conference, Munich 2003, Oct. 7-9, 2003, pp. 159-162.

Tsui, Hau-Yiu et al., Experimental Results and Die Area Efficient Self-Shielded On-Chip Vertical Solenoid Inductors for Multi-GHz CMOS RFIC, Department of Electrical and Electronic Engineering, MO3D-1, 2003 IEEE MTT-S Digest, Jun. 8-13, 2003, pp. 243-246.

Zolfaghari, A., et al., Stacked Inductors and Transformers in CMOS Technology, IEE Journal of Solid State Circuits, vol. 36, No. 4, Apr. 2001, pp. 620-628.

* cited by examiner

MULTIPLE-LOOP SYMMETRICAL INDUCTOR

CROSS-REFERENCE TO RELATED APPLICATIONS

This application is a divisional of U.S. patent application having the application Ser. No. 12/906,006 filed on Oct. 15, 2010 and titled "A Multiple-Loop Symmetrical Inductor" by Vassili Kireev, Parag Upadhyaya, and Mark J. Marlett.

FIELD OF THE INVENTION

One or more embodiments generally relate to inductors, and more particularly to inductors implemented in an integrated circuit.

BACKGROUND

Inductors are useful for implementing electronic filters and resonant circuits. However, inductors in integrated circuits occupy significant area to achieve the needed inductance, and inductors with a high quality factor, Q, are difficult to implement in an integrated circuit.

One or more embodiments of the present invention may address one or more of the above issues.

SUMMARY

In one embodiment, a symmetrical inductor includes an integrated circuit having a plurality of conductive layers. A first loop is disposed in an upper layer of the conductive layers, and at least two strapped loops are disposed in at least two layers of the conductive layers, respectively. The strapped loops are coupled in series to the first loop, and the at least two layers are below the upper layer. A second loop is disposed in the upper layer and is coupled in series to the at least two strapped loops. A first terminal electrode is coupled to the first loop, and a second terminal electrode is coupled to the second loop. A center-tap electrode is coupled to the at least two strapped loops.

In another embodiment, a symmetrical inductor includes a plurality of half-loop pairs in a plurality of respective conductive layers of an integrated circuit. Each half-loop pair includes a first and second half-loop in the respective conductive layer. A first and a second terminal electrode are both in a first conductive layer of the plurality of respective conductive layers. A center-tap electrode is in a second conductive layer of the plurality of respective conductive layers. The first terminal electrode and the center-tap electrode are coupled through a first series combination of the first half-loop of each of the plurality of half-loop pairs, and the second terminal electrode and the center-tap electrode are coupled through a second series combination of the second half-loop of each of the plurality of half-loop pairs. The plurality of half-loop pairs includes first, second, and third half-loop pairs. The first and second half-loop pairs are respectively an outer and inner half-loop pair, and both are implemented in the first conductive layer. The third half-loop pair is implemented in the second conductive layer. The first terminal electrode is coupled to the center-tap electrode through the first series combination of the first half-loop of the first half-loop pair, the first half-loop of the second half-loop pair, and the first half-loop of the third half-loop pair, in that order. The first half-loop of the first half-loop pair is in the first conductive layer on a first side of two sides of the symmetrical inductor. The first half-loop of the second half-loop pair is in the first conductive layer on a second side of the two sides. The first half-loop of the third half-loop pair is in the second conductive layer on the first side. The second terminal electrode is coupled to the center-tap electrode through the second series combination of the second half-loop of the first half-loop pair, the second half-loop of the second half-loop pair, and the second half-loop of the third half-loop pair, in that order. The second half-loop of the first half-loop pair is in the first conductive layer on the second side, the second half-loop of the second half-loop pair is in the first conductive layer on the first side, and the second half-loop of the third half-loop pair is in the second conductive layer on the second side.

A method of forming a symmetrical inductor is provided in another embodiment. The method includes forming a first loop in an upper layer of a plurality of conductive layers in an integrated circuit. At least two strapped loops are formed in at least two layers of the conductive layers, respectively. The at least two layers are below the upper layer. The at least two strapped loops are coupled in series to the first loop. A second loop is formed in the upper layer. The second loop is coupled in series to the at least two strapped loops. A first terminal electrode and a second terminal electrode are formed in the upper layer. The first terminal electrode is coupled to the first loop. The second terminal electrode is coupled to the second loop. A center-tap electrode is formed in a lower layer of the at least two layers. The center-tap electrode is coupled to the at least two strapped loops.

It will be appreciated that various other embodiments are set forth in the Detailed Description and Claims which follow.

BRIEF DESCRIPTION OF THE DRAWINGS

Various aspects and advantages of the disclosed embodiments will become apparent upon review of the following detailed description and upon reference to the drawings in which.

DETAILED DESCRIPTION OF THE DRAWINGS

Figure 1:
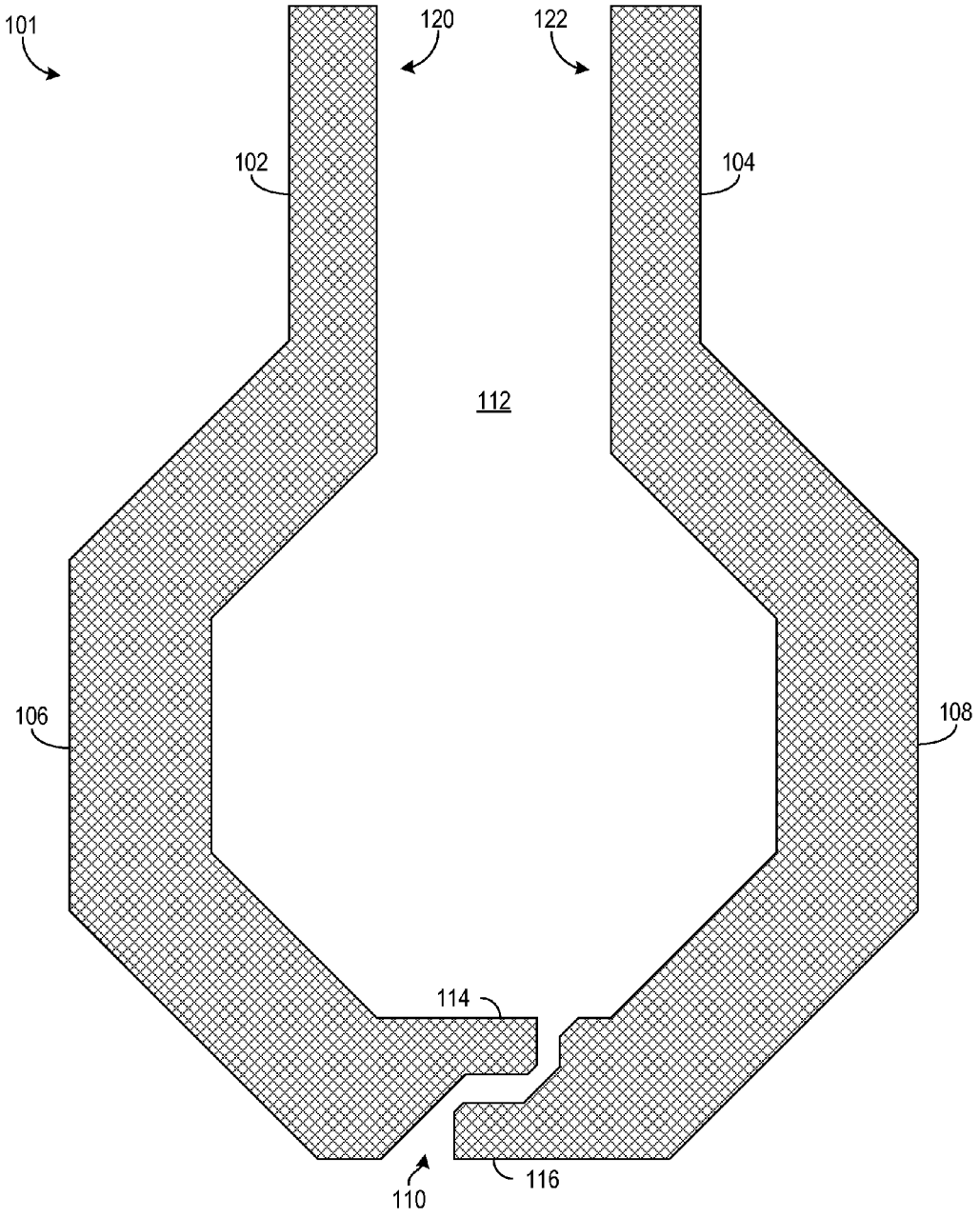
FIG. 1 is a layout diagram of one conductive layer of a two loop symmetrical inductor in accordance with one or more embodiments of the invention.
Figure 2:
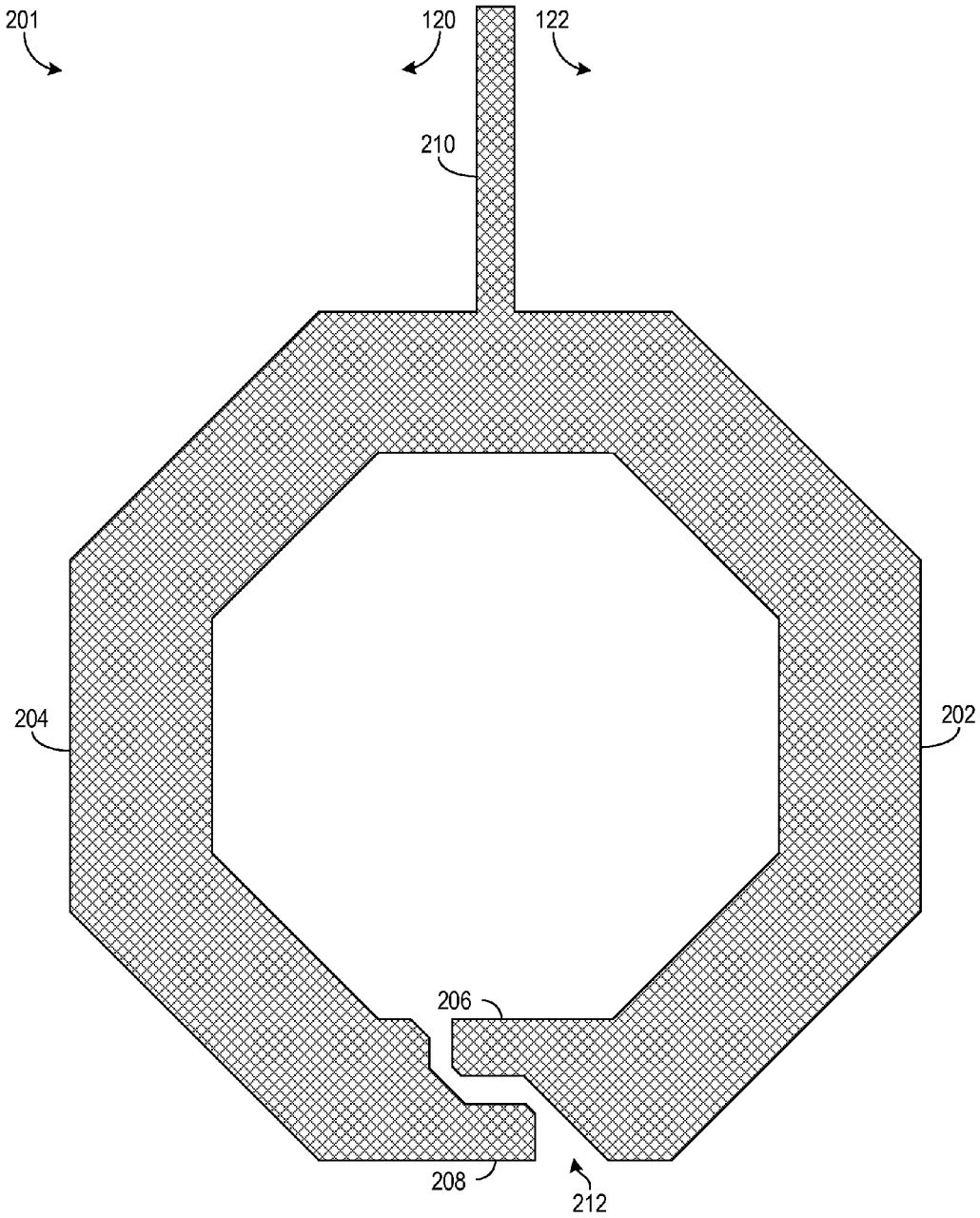
FIG. 2 is a layout diagram of another conductive layer of the two loop symmetrical inductor of FIG. 1.

FIG. 1 is a layout diagram of one conductive layer of a two loop symmetrical inductor in accordance with one or more embodiments of the invention. FIG. 1 shows a pair of half-loops on a first metal layer 101 of the symmetrical inductor and FIG. 2 shows a pair of half-loops on a second metal layer 201 of the symmetrical inductor. In one embodiment, the metal layers 101 and 201 shown in FIGS. 1 and 2 are different metal layers of an integrated circuit.

The symmetrical inductor has two terminal electrodes 102 and 104 in the first metal layer 101 shown in FIG. 1. The first half-loop pair includes two half-loops 106 and 108, and the half-loops 106 and 108 are separated by an associated non-conductive region of absence 110 of the first metal layer 101. Another non-conductive region of absence 112 of the first metal layer 101 separates the terminal electrodes 102 and 104 and the two half-loops 106 and 108 of the first half-loop pair.

FIG. 2 is a layout diagram of another conductive layer 201 of the two loop symmetrical inductor of FIG. 1. The symmetrical inductor couples the half-loops 106 and 108 shown in FIG. 1 and the half-loops 202 and 204 shown in FIG. 2. The symmetrical inductor couples the contact area 114 of the half-loop 106 of the first half-loop pair and the contact area 206 of the half-loop 202 of the second half-loop pair. Similarly, the symmetrical inductor couples the contact area 116 of the half-loop 108 and the contact area 208 of the half-loop 204.

The symmetrical inductor has a center-tap electrode 210 in the second metal layer 201 shown in FIG. 2. In one embodiment, the center-tap electrode is disposed along an axis of symmetry between the left side 120 and the right side 122 of the symmetrical inductor. In FIG. 1, terminal electrode 102 is disposed on the left side 120 of the symmetrical inductor and terminal electrode 104 is disposed on the right side 122 of the symmetrical inductor.

A non-conductive region of absence 212 of the second metal layer 201 is associated with the second half-loop pair, and the non-conductive region of absence 212 separates the half-loops 202 and 204. The center-tap electrode 210 also separates the half-loops 202 and 204.

In one embodiment, the first half-loop pair shown in FIG. 1 and the second half-loop pair shown in FIG. 2 are substantially coextensive in two lateral dimensions of the integrated circuit. Except in the non-conductive regions of absence 110, 112, and 212 of the first and second metal layers 101 and 201, the first and second half-loop pairs are coextensive in the two lateral dimensions through the plane of FIGS. 1 and 2. Thus, projections of the first and second half-loop pairs into the surface of the integrated circuit are identical, excluding the projections of the non-conductive regions of absence 110, 112, and 212. The two lateral dimensions are perpendicular, and the two half-loop pairs shown in FIGS. 1 and 2 are stacked and separated along a vertical dimension that is perpendicular to both of the two lateral dimensions.

In one embodiment, the pair of half-loops 106 and 108 are matching half-loops because, except in the non-conductive region of absence 110, they are mirror images of each other about the axis of symmetry between the left side 120 and the right side 122. Similarly, the pair of half-loops 202 and 204 are matching half-loops because they mirror each other except in the non-conductive region of absence 212.

Figure 3:
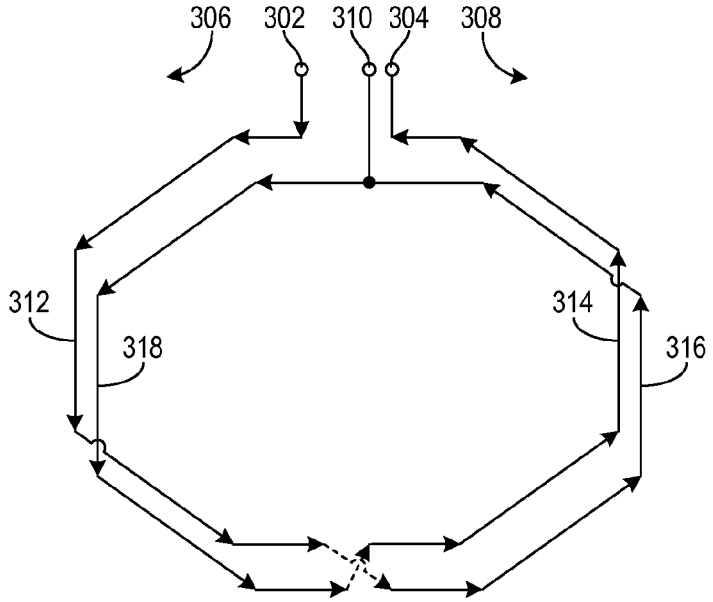
FIG. 3 is a simplified perspective diagram of the two loop symmetrical inductor of FIGS. 1 and 2.

FIG. 3 is a simplified perspective diagram of the two loop symmetrical inductor of FIGS. 1 and 2. FIG. 3 shows the overall symmetry of the inductor. Contacts making connections between conductive layers are shown with arrows having dotted lines.

The symmetrical inductor includes terminal electrodes 302 and 304 on an upper conductive layer of an integrated circuit, and terminal electrode 302 is on one side 306 of the inductor and terminal electrode 304 is on the other side 308 of the inductor. The symmetrical inductor also includes a center-tap electrode 310 on a lower conductive layer centered between the sides 306 and 308.

The first half-loop pair is on the upper conductive layer and includes half-loops 312 and 314. The second half-loop pair is on the lower conductive layer and includes half-loops 316 and 318.

The first terminal electrode 302 and the center-tap electrode 310 are coupled through a first series combination of the half-loops 312 and 316 of the half-loop pairs, and the second terminal electrode 304 and the center-tap electrode 310 are coupled through a second series combination of the half-loops 314 and 318 of the half-loop pairs. Thus, the first series combination includes one half-loop of each half-loop pair, and the second series combination includes the other half-loop of each half-loop pair.

The half-loops 312 and 316 are connected in the first series combination in that order, and the half-loops 314 and 318 are connected in the second series combination in that order. Both the first and second series combinations begin with respective half-loops 312 and 314 on the upper conductive layer, and both the first and second series combinations end with respective half-loops 316 and 318 on the lower conductive layer. The sequence of conductive layers for both series combinations begins with the upper conductive layer and ends with the lower conductive layer. Thus, there are identical sequences of conductive layers for both series combinations.

The first half-loop pair contributes the initial half-loop 312 appearing in the first series combination and the initial half-loop 314 appearing in the second series combination. The second half-loop pair contributes the final half-loop 316 appearing in the first series combination and the final half-loop 318 appearing in the second series combination. Thus, the half-loops 312 and 314 of the first pair appear in matching initial positions in the first and second series combinations, and the half-loops 316 and 318 of the second pair appear in matching final positions in the first and second series combinations.

Each of the half-loops 312, 314, 316, and 318 is on one of the sides 306 and 308 of the symmetrical inductor. The first series combination starts with half-loop 312 on the side 306 of the first terminal electrode 302, and the first series combination ends with half-loop 316 on side 308. Similarly, the second series combination starts with half-loop 314 on the side 308 of the second terminal electrode 304 and ends with half-loop 318 on side 306. Thus, the half-loops 312 and 316 in the first series combination alternate between the sides 306 and 308, and the half-loops 314 and 318 in the second series combination alternate between sides 308 and 306.

In one embodiment, the conductive layers are a lower metal layer and an upper metal layer created or disposed in the integrated circuit in that order. The first terminal electrode 302 is coupled to the center-tap electrode 310 through the first series combination of the first half-loop 312 of the first half-loop pair and the first half-loop 316 of the second half-loop pair, in that order. The first half-loop 312 of the first half-loop pair is in the upper metal layer on the first side 306 of the symmetrical inductor, and the first half-loop 316 of the second half-loop pair is in the lower metal layer on the second side 308. The second terminal electrode 304 is coupled to the center-tap electrode 310 through the second series combination of the second half-loop 314 of the first half-loop pair and the second half-loop 318 of the second half-loop pair, in that order. The second half-loop 314 of the first half-loop pair is in the upper metal layer on the second side 308, and the second half-loop 318 of the second half-loop pair is in the lower metal layer on the first side 306.

The inductor has symmetry relative to the center-tap electrode 310 because the path from either terminal electrode 302 or 304 to the center-tap electrode 310 is a series combination through respective half-loops, which alternate between sides 306 and 308 in a sequence through matching half-loop pairs on identical conductive layers.

The half-loop pairs are stacked in various embodiments. When the half-loop pairs are stacked close together and substantially coextensive in the two lateral dimensions of the integrated circuit, the magnetic flux generated by each half-loop pair is generally coupled through all the other half-loop pairs. When this occurs, the inductance generated by the inductor is proportional to the square of the number of conductive loops. Because of this, the size of the inductor can be dramatically reduced for a specified inductance, and an integrated circuit can implement many more of these inductors.

Various embodiments provide stacked inductors that operate over an extended frequency range. The quality factor, Q, of an inductor is its reactance divided by its resistance. As the frequency of the signal passing through an inductor increases, parasitic elements cause the inductor Q to drop. When the inductor Q drops too low, the application circuit including the inductor operates with reduced utility, or fails to operate at all. For example, an inductor is useful to implement an LC resonant tank circuit of a variable oscillator. An inductor with high Q reduces the jitter of the variable oscillator. As the variable oscillator tunes to progressively higher frequencies, the Q drops until the jitter becomes unacceptable or the resonant tank circuit fails to oscillate. It was discovered that an inductor with symmetry coupled less noise in a differential implementation of an application circuit.

Figure 4:
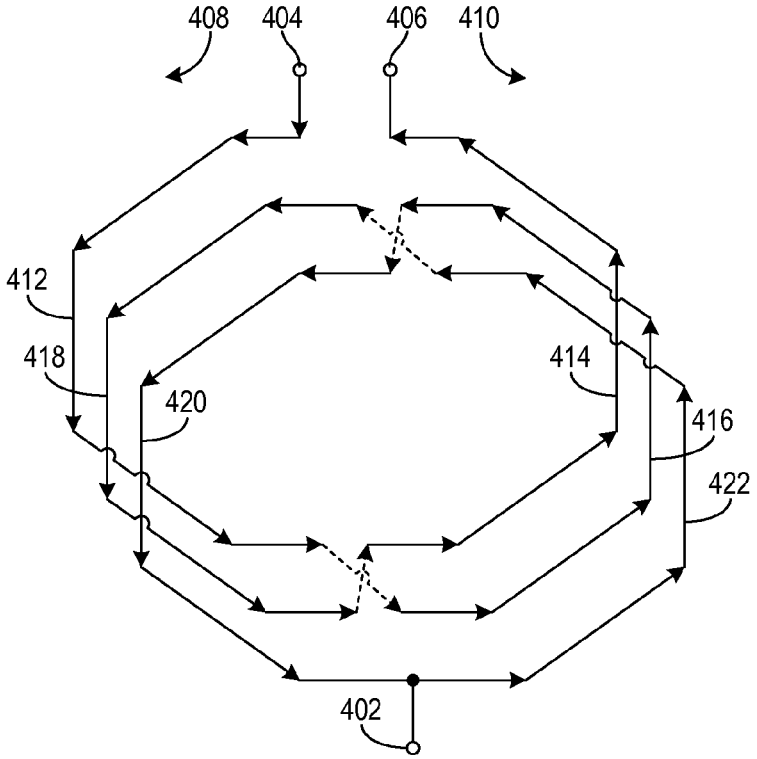
FIG. 4 is a simplified perspective diagram of a symmetrical inductor having three loops on three conductive layers in accordance with one or more embodiments of the invention.

FIG. 4 is a simplified perspective diagram of a symmetrical inductor having three loops on three conductive layers in accordance with one or more embodiments of the invention. The inductor has symmetry relative to the center-tap electrode 402 because the path from either terminal electrode 404 or 406 to the center-tap electrode 402 is a series combination through respective half-loops on alternating sides 408 and 410 of matching conductive layers.

The first half-loop pair is on the upper conductive layer of the terminal electrodes 404 and 406 and includes half-loop 412 on side 408 and half-loop 414 on side 410; the second half-loop pair is on a middle conductive layer and includes half-loop 416 on side 410 and half-loop 418 on side 408; and the third half-loop pair is on the lower conductive layer of the center-tap electrode 402 and includes half-loop 420 on side 408 and half-loop 422 on side 410.

The first terminal electrode 404 is coupled to the center-tap electrode 402 through the first series combination of the first half-loop 412 of the first pair, the first half-loop 416 of the second pair, and the first half-loop 420 of the third pair, in that order. The first half-loop 412 of the first pair is in the upper conductive layer on a first side 408 of the symmetrical inductor, the first half-loop 416 of the second pair is in the middle conductive layer on a second side 410, and the first half-loop 420 of the third pair is in the lower conductive layer on the first side 408.

The second terminal electrode 406 is coupled to the center-tap electrode 402 through the second series combination of the second half-loop 414 of the first pair, the second half-loop 418 of the second pair, and the second half-loop 422 of the third pair, in that order. The second half-loop 414 of the first pair is in the upper conductive layer on the second side 410, the second half-loop 418 of the second pair is in the middle conductive layer on the first side 408, and the second half-loop 422 of the third pair is in the lower conductive layer on the second side 410.

Figure 5:
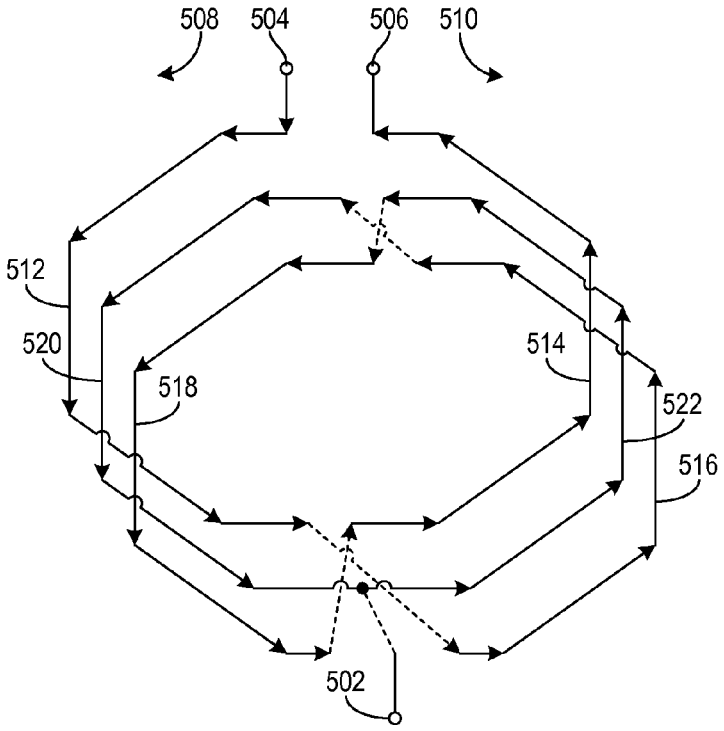
FIG. 5 is a simplified perspective diagram of another symmetrical inductor having three loops on three conductive layers in accordance with one or more embodiments of the invention.

FIG. 5 is a simplified perspective diagram of another symmetrical inductor having three loops on three conductive layers in accordance with one or more embodiments of the invention. FIG. 5 rearranges the conductive layers of the symmetrical inductor of FIG. 4 while maintaining symmetry relative to the center-tap electrode 502.

The first half-loop pair is on the upper conductive layer of the terminal electrodes 504 and 506 and includes half-loop 512 on side 508 and half-loop 514 on side 510; the second half-loop pair is on a lower conductive layer and includes half-loop 516 on side 510 and half-loop 518 on side 508; and the third half-loop pair is on a middle conductive layer and includes half-loop 520 on side 508 and half-loop 522 on side 510.

When a current flows through an inductor, a voltage drop occurs across the impedance of each successive half-loop 512, 514, 516, 518, 520, and 522. The complete series combination of half-loops between electrodes 504 and 506 includes half-loops 512, 516, 520, 522, 518, and 514, in that order. The voltage differential between two half-loops increases with increasing separation in this series combination.

The half-loops 512, 514, 516, 518, 520, and 522 have parasitic capacitance between them and the parasitic capacitance is predominately between half-loops on the same side of adjacent conductive layers. Thus, the predominate parasitic capacitances are between half-loop 520 and its physically adjacent half-loops 512 and 518, and half-loop 522 and its physically adjacent half-loops 514 and 516.

The detrimental effect from each parasitic capacitance is roughly a product of the parasitic capacitance and the voltage drop across the parasitic capacitance. Voltage distribution for frequencies below self-resonance is defined by inductance. The more voltage drop between adjacent layers, the more effective capacitance between them. Therefore, an arrangement with less voltage drop between layers will have less parasitic capacitance. Half-loop 520 is separated by one half-loop 516 from half-loop 512, and half-loop 520 is separated by one half-loop 522 from half-loop 518. Similarly, half-loop 522 is separated by one half-loop 518 from half-loop 514, and half-loop 522 is separated by one half-loop 520 from half-loop 516. Thus, the inductor of FIG. 5 has a detrimental effect from parasitic capacitance between the half-loops 512, 514, 516, 518, 520, and 522 that is roughly four parasitic capacitances times the voltage differential across one half-loop.

In contrast, the inductor of FIG. 4 has a detrimental effect from parasitic capacitance between half-loops 412, 414, 416, 418, 420, and 422 that is roughly four parasitic capacitances times the voltage differential across three half-loops. Thus, the arrangement of the conductive layers in the inductor of FIG. 5 is a significant improvement over the arrangement of the conductive layers in the inductor of FIG. 4.

In the illustrated embodiment of FIG. 5, the center-tap electrode 502 is on the lower conductive layer and is connected via a contact between half-loops 520 and 522 in the middle conductive layer. In another embodiment, the center-tap electrode is on the middle conductive layer directly connected between half-loops 520 and 522.

Figure 6:
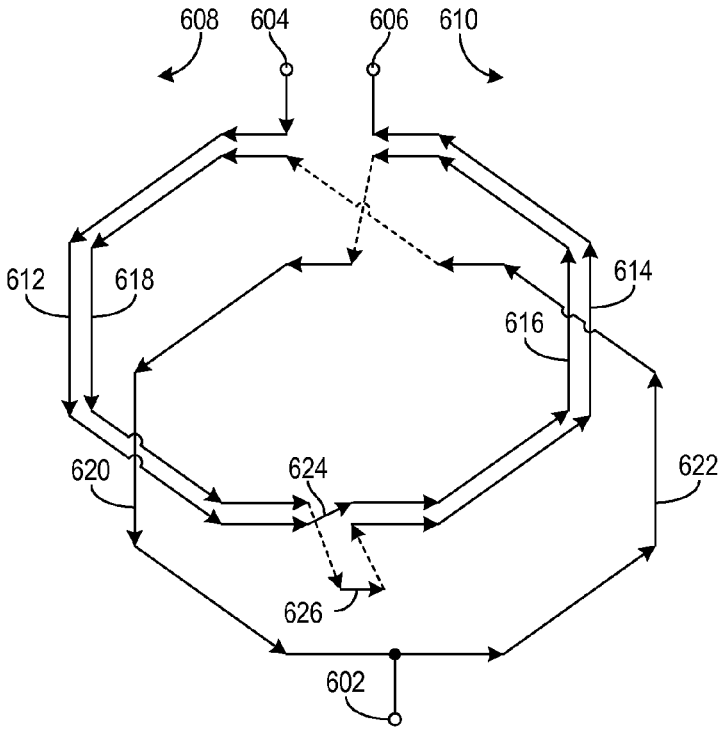
FIG. 6 is a simplified perspective diagram of a three-loop symmetrical inductor having two loops on one conductive layer in accordance with one or more embodiments of the invention.

FIG. 6 is a simplified perspective diagram of a three loop symmetrical inductor having two loops on one conductive layer in accordance with one or more embodiments of the invention. The inductor has symmetry relative to the center-tap electrode 602 because the path from either terminal electrode 604 or 606 to the center-tap electrode 602 is a series combination through respective half-loops on alternating sides 608 and 610 of matching conductive layers.

The first half-loop pair is an outer pair on the upper conductive layer of the terminal electrodes 604 and 606. The first half-loop pair includes half-loop 612 on side 608 and half-loop 614 on side 610. The second half-loop pair is an inner pair also on the upper conductive layer inside the outer pair of half-loops 612 and 614. The second half-loop pair includes half-loop 616 on side 610 and half-loop 618 on side 608. The third half-loop pair is on a lower conductive layer and includes half-loop 620 on side 608 and half-loop 622 on side 610.

The first terminal electrode 604 is coupled to the center-tap electrode 602 through the first series combination of the first half-loop 612 of the first pair, the first half-loop 616 of the second pair, and the first half-loop 620 of the third pair, in that order. The first half-loop 612 of the first pair is in the upper conductive layer on the first side 608, the first half-loop 616 of the second pair is in the upper conductive layer on the second side 610, and the first half-loop 620 of the third pair is in the lower conductive layer on the first side 608.

The second terminal electrode 606 is coupled to the center-tap electrode 602 through the second series combination of the second half-loop 614 of the first pair, the second half-loop 618 of the second pair, and the second half-loop 622 of the third pair, in that order. The second half-loop 614 of the first pair is in the upper conductive layer on the second side 610, the second half-loop 618 of the second pair is in the upper conductive layer on the first side 608, and the second half-loop 622 of the third pair is in the lower conductive layer on the second side 610.

A cross-over connection includes a portion 624 in the upper conductive layer of both the outer pair of half-loops 612 and 614 and the inner pair of half-loops 616 and 618. Portion 624 of the cross-over connection couples half-loop 612 of the outer pair and half-loop 616 of the inner pair. The cross-over connection also includes a portion 626 in a middle conductive layer of the integrated circuit. Portion 626 of the cross-over connection couples half-loop 614 of the outer pair and half-loop 618 of the inner pair. The center-tap electrode 602 and the cross-over connection having portions 624 and 626 separate the half-loops 612 and 614 of the outer pair on the upper conductive layer, the half-loops 616 and 618 of the inner pair on the upper conductive layer, and the half-loops 620 and 622 of the pair on the lower conductive layer.

Figure 7:
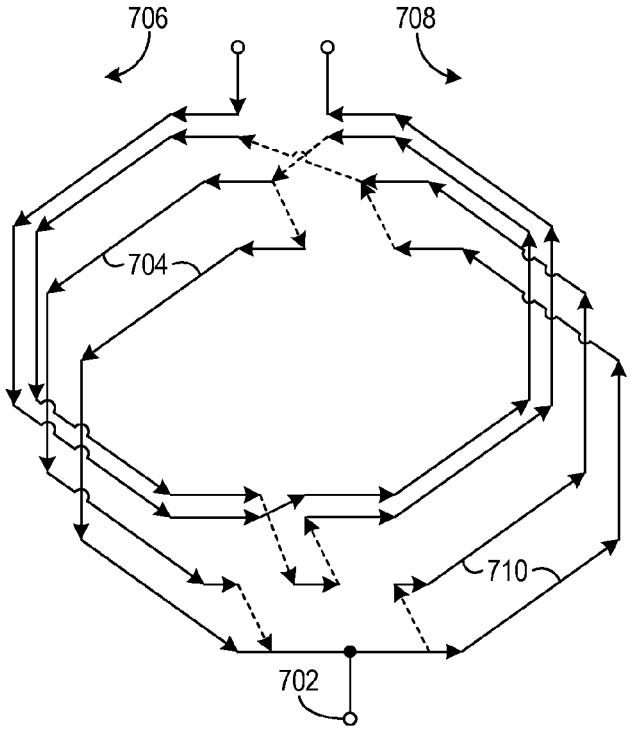
FIGS. 7 and 8 are simplified perspective diagrams of additional three-loop symmetrical inductors having two loops on one conductive layer in accordance with one or more embodiments of the invention.
Figure 8:
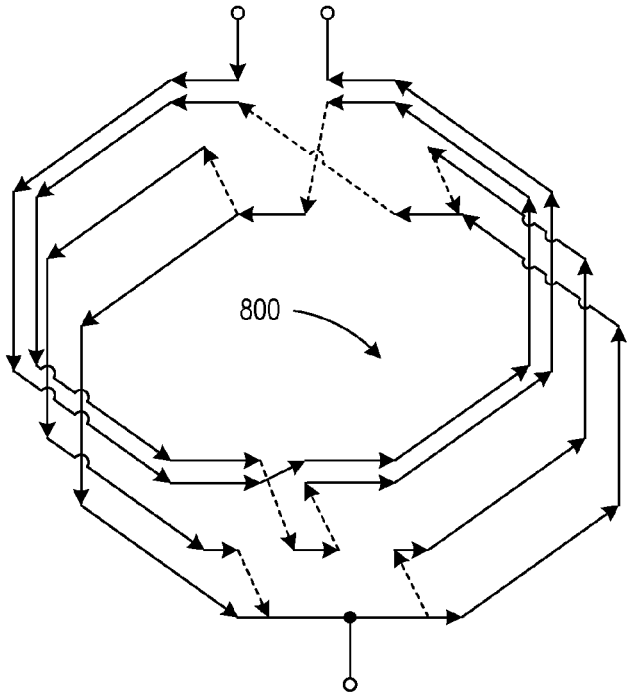

FIGS. 7 and 8 are simplified perspective diagrams of additional three-loop symmetrical inductors having two loops on one conductive layer in accordance with one or more embodiments of the invention. FIGS. 7 and 8 are modifications of the symmetrical inductor of FIG. 6.

The metal layers in a fabrication process of an integrated circuit are generally different. For example, the upper metal layers are generally thicker and have a lower resistance per square than the lower metal layers. Thus, when a half-loop in an upper metal layer is coextensive in two lateral dimensions with a half-loop in a lower metal layer, the half-loop in the lower metal layer generally has a higher resistance than the half-loop in the upper metal layer. To counteract this higher resistance per square of the lower metal layers, two or more of the lower metal layers are strapped together, resulting in a resistance per square of the strapped lower metal layers that approaches or is even lower than the resistance per square of the upper metal layers.

In FIG. 7, the first half-loop 704 of the third half-loop pair is implemented on the first side 706 in both the lower conductive layer of the center-tap electrode 702 and the middle conductive layer, and the second half-loop 710 of the third half-loop pair is implemented on the second side 708 in both the lower conductive layer and the middle conductive layer.

FIG. 8 similarly straps the lower metal layer and the middle metal layer of a symmetrical inductor 800.

Figure 9:
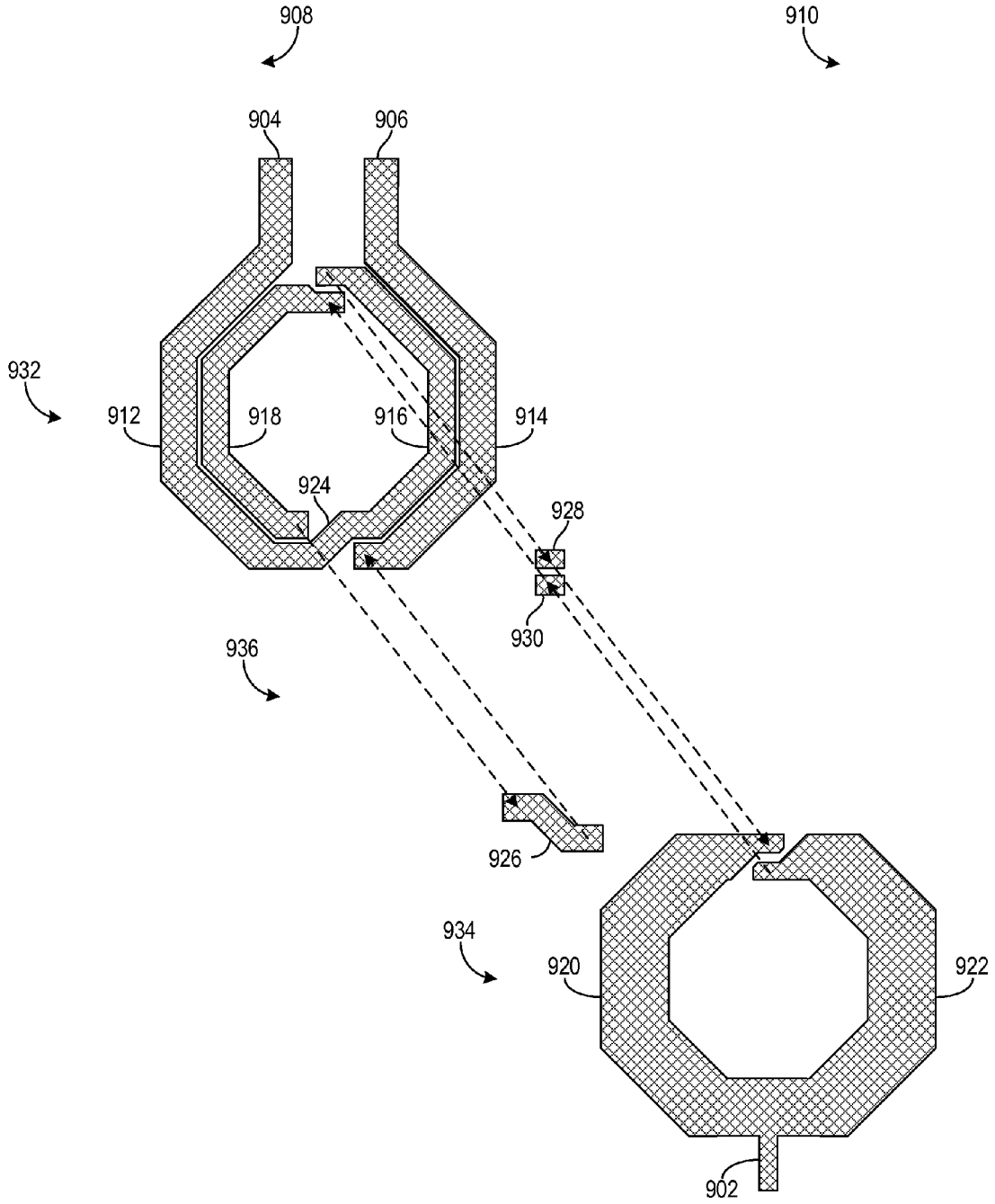
FIG. 9 is an exploded layout diagram of an embodiment of the three-loop symmetrical inductor of FIG. 6.

FIG. 9 is an exploded layout diagram of an embodiment of the three-loop symmetrical inductor of FIG. 6. The three half-loop pairs are on an upper metal layer 932 and a lower metal layer 934, with a middle metal layer 936 providing connections between the upper metal layer 932 and the lower metal layer 934. The inductor has symmetry relative to the center-tap electrode 902.

The first half-loop pair is an outer pair on the upper metal layer 932 of the terminal electrodes 904 and 906. The first half-loop pair includes half-loop 912 on side 908 and half-loop 914 on side 910. The second half-loop pair is an inner pair also on the upper metal layer 932 inside the outer pair of half-loops 912 and 914. The second half-loop pair includes half-loop 916 on side 910 and half-loop 918 on side 908. The third half-loop pair is on a lower metal layer 934 and includes half-loop 920 on side 908 and half-loop 922 on side 910.

The first terminal electrode 904 is coupled to the center-tap electrode 902 through the first series combination of the first half-loop 912 of the first pair, the cross-over connection 924 on the upper metal layer 932, the first half-loop 916 of the second pair, the connection 928 on the middle metal layer 936, and the first half-loop 920 of the third pair, in that order.

The second terminal electrode 906 is coupled to the center-tap electrode 902 through the second series combination of the second half-loop 914 of the first pair, the cross-over connection 926 on the middle metal layer 936, the second half-loop 918 of the second pair, the connection 930 on the middle metal layer 936, and the second half-loop 922 of the third pair, in that order.

In the illustrated embodiment, the combination of the half-loops 912, 914, 916, and 918 on the upper metal layer 932 is substantially coextensive in two lateral dimensions with the half-loops 920 and 922 on the lower metal layer 934. In another embodiment, the half-loops 920 and 922 on the lower metal layer 934 have respective slots (not shown) partially or fully coextensive with the space separating half-loops 912 and 918 on the upper metal layer 932 and a similar space separating half-loops 914 and 916.

In one embodiment, the pair of half-loops 912 and 914 are matching half-loops because they are symmetrical mirror images of each other, except near the connections 924 and 926. Similarly, the pair of half-loops 916 and 918 are matching half-loops and the pair of half-loops 920 and 922 are matching half-loops because they are substantially symmetrical.

One or more embodiments of the present invention are thought to be applicable to a variety of systems that include inductors. Other aspects and embodiments will be apparent to those skilled in the art from consideration of the specification and practice of the one or more embodiments disclosed herein. The embodiments may be implemented in an application specific integrated circuit (ASIC), or in a programmable logic device. It is intended that the specification and illustrated embodiments be considered as examples only, with a true scope and spirit of the invention being indicated by the following claims.

What is claimed is:

1. A symmetrical inductor, comprising:

a plurality of conductive layers;

a first loop disposed in an upper layer of the conductive layers;

a second loop disposed in the upper layer;

a third loop that includes a first half-loop and a second half-loop, wherein:

the first half-loop includes a first half-loop portion in a first layer below the upper layer and a second half-loop portion in a second layer below the first layer, and first ends of the first and second half-loop portions are connected to a first end of the first loop; and the second half-loop includes a third half-loop portion in the first layer and a fourth half-loop portion in the second layer, and first ends of the third and fourth half-loop portions are connected to a first end of the second loop;

a first terminal electrode coupled to a second end of the first loop;

a second terminal electrode coupled to a second end of the second loop; and a center-tap electrode connected to second ends of the first and second half-loop portions and connected to second ends of the third and fourth half-loop portions.

2. The symmetrical inductor of claim 1, wherein the first terminal electrode is disposed in the upper layer.

3. The symmetrical inductor of claim 1, wherein the second terminal electrode is disposed in the upper layer.

4. The symmetrical inductor of claim 1, wherein the center-tap electrode is disposed in the second layer.

5. The symmetrical inductor of claim 1, wherein the first loop is connected in series first to the first end of the first half-loop portion and next to the first end of the second half-loop portion.

6. The symmetrical inductor of claim 1, wherein the first loop is connected in series first to the first end of the second half-loop portion and next to the first end of the first half-loop portion.

7. The symmetrical inductor of claim 1, wherein the first loop includes a first half loop and a second half loop, and the second loop includes a first half loop and a second half loop, a connection between the first half loop and the second half loop of the first loop crosses the second loop, and a connection between the first half loop and the second half loop of the second loop crosses the first loop.

8. A symmetrical inductor, comprising:

a plurality of half-loop pairs in a plurality of respective conductive layers, each half-loop pair including a first and second half-loop in the respective conductive layer;

a first and second terminal electrode that are both in a first conductive layer of the plurality of respective conductive layers;

a center-tap electrode in a second conductive layer of the plurality of respective conductive layers;

wherein the first terminal electrode and the center-tap electrode are coupled through a first series combination of the first half-loop of each of the plurality of half-loop pairs, and the second terminal electrode and the center-tap electrode are coupled through a second series combination of the second half-loop of each of the plurality of half-loop pairs;

wherein the plurality of half-loop pairs includes first, second, and third half-loop pairs, the first and second half-loop pairs respectively being an outer and inner half-loop pair, both implemented in the first conductive layer, and the third half-loop pair being implemented in the second conductive layer;

wherein the first terminal electrode is coupled to the center-tap electrode through the first series combination of the first half-loop of the first half-loop pair, the first half-loop of the second half-loop pair, and the first half-loop of the third half-loop pair, in that order;

wherein the first half-loop of the first half-loop pair is in the first conductive layer on a first side of two sides of the symmetrical inductor, the first half-loop of the second half-loop pair is in the first conductive layer on a second side of the two sides, and the first half-loop of the third half-loop pair is in the second conductive layer on the first side;

wherein the second terminal electrode is coupled to the center-tap electrode through the second series combination of the second half-loop of the first half-loop pair, the second half-loop of the second half-loop pair, and the second half-loop of the third half-loop pair, in that order; and wherein the second half-loop of the first half-loop pair is in the first conductive layer on the second side, the second half-loop of the second half-loop pair is in the first conductive layer on the first side, and the second half-loop of the third half-loop pair is in the second conductive layer on the second side.

9. The symmetrical inductor of claim 8, wherein the first half-loop of the third half-loop pair is implemented on the first side in both the second conductive layer and a third conductive layer, and the second half-loop of the third half-loop pair is implemented on the second side in both the second conductive layer and the third conductive layer.

10. The symmetrical inductor of claim 9, wherein the first half-loop of the second half-loop pair is connected in series first to a part of the first half-loop of the third half-loop pair in the second conductive layer.

11. The symmetrical inductor of claim 9, wherein the first half-loop of the second half-loop pair is connected in series first to a part of the first half-loop of the third half-loop pair in the third conductive layer.

12. The symmetrical inductor of claim 8, wherein a series connection of the first half-loop of the first half-loop pair to the first half-loop of the second half-loop pair crosses a series connection of the second half-loop of the second half-loop pair to the second half-loop of the first half-loop pair.

13. A method of forming a symmetrical inductor, comprising:

forming a first loop in an upper layer of a plurality of conductive layers;

forming a second loop in the upper layer;

forming a third loop that includes a first half-loop and a second half-loop, wherein:

the first half-loop includes a first half-loop portion in a first layer below the upper layer and a second half-loop portion in a second layer below the first layer; and the second half-loop includes a third half-loop portion in the first layer and a fourth half-loop portion in the second layer;

coupling first ends of the first and second half-loop portions to a first end of the first loop;

coupling first ends of the third and fourth half-loop portions to a first end of the second loop;

forming a first terminal electrode and a second terminal electrode in the upper layer;

coupling the first terminal electrode to a second end of the first loop;

coupling the second terminal electrode to a second end of the second loop;

forming a center-tap electrode in a lower layer of the at least two layers; and coupling the center-tap electrode to second ends of the first and second half-loop portions and to second ends of the third and fourth half-loop portions.

14. The method of claim 13, wherein the coupling of first ends of the first and second half-loop portions to a first end of the first loop includes connecting the first end of the first loop in series first to the first end of the first half-loop portion and next to the first end of the second half-loop portion.

15. The method of claim 13, wherein the coupling of first ends of the first and second half-loop portions to a first end of the first loop includes connecting the first end of the first loop in series first to the first end of the second half-loop portion and next to the first end of the first half-loop portion.

16. The method of claim 13, wherein the first loop includes a first half loop and a second half loop, and the second loop includes a first half loop and a second half loop, a connection between the first half loop and the second half loop of the first loop crosses the second loop, and a connection between the first half loop and the second half loop of the second loop crosses the first loop.

* * * * *